United States Patent [19]

Chikara et al.

[11] Patent Number: 4,788,535

[45] Date of Patent: Nov. 29, 1988

[54] DISPLAY APPARATUS

[75] Inventors: Yoshihisa Chikara; Mitsutoshi Hirata, both of Fukuoka; Shuichi Takatori, Chikushi, all of Japan

[73] Assignee: Matsushita Electric Industrial Co., Ltd., Kadoma, Japan

[21] Appl. No.: 117,438

[22] Filed: Nov. 2, 1987

Related U.S. Application Data

[63] Continuation of Ser. No. 669,512, Nov. 8, 1984, abandoned.

[30] Foreign Application Priority Data

Nov. 10, 1983 [JP] Japan ..... 58-211315
Nov. 10, 1983 [JP] Japan ..... 58-211316
Nov. 10, 1983 [JP] Japan ..... 58-211317

[51] Int. Cl.[4] ..... G09G 1/16

[52] U.S. Cl. ..... 340/703; 340/701; 340/791

[58] Field of Search ..... 340/701, 703, 709, 730, 340/747, 748, 723, 791

[56] References Cited

U.S. PATENT DOCUMENTS 4,028,695 6/1977 Saich ..... 340/709
4,467,322 8/1984 Bell et al. ..... 340/703

FOREIGN PATENT DOCUMENTS 0074641 6/1980 Japan ..... 340/703
2146198 4/1985 United Kingdom ..... 340/701

*Primary Examiner*—Gerald L. Brigance
*Attorney, Agent, or Firm*—Cushman, Darby & Cushman

[57] ABSTRACT

A display apparatus having an inverting circuit which can be switched to invert white signals into black signals and black signals into white signals of image signal to reverse the contract of a black and white signal. This contrast can be switched independent of other color signals, or other color signals can be changed to complementary colors. The background color contrast can also be changed.

5 Claims, 7 Drawing Sheets

DISPLAY APPARATUS

This is a continuation of application Ser. No. 669,512 filed Nov. 8, 1984 which was abandoned upon the filing hereof.

BACKGROUND OF THE INVENTION

1. Field of the Invention

The present invention relates generally to a display apparatus and more particularly to a display apparatus adapted for use in a word-processor, a computer or the like.

2. Description of the Prior Art

The prior Art display apparatus used in a word-processor or the like displays white letters or white figures on a black background. The displayed white letters or white figures, when printed, are printed out in black letters or black figures on a white background (i.e. white paper). Such discord between white and black gives an operator an unnatural feeling.

Some programs have been proposed to eliminate the unnatural feeling to the the operator. Such programs reverse the colors between the background and figures of the image displayed on a display apparatus and thus make the displayed picture have black letters or black figures on a white background. However, such a solution uses a software program and therefore has disadvantages as (a) it necessitates making special software, (b) the software is very expensive, and (c) much loading time for software is necessary.

SUMMARY OF THE INVENTION

The present invention provides a display apparatus which has no such disadvantages.

It is an object of the invention to get a reversed picture which has negative colors of black and white as compared with colors of a normal picture, by an easy mechanical operation, without the necessity to make and load software.

Another object of the invention is to get a reversed picture which has complementary colors to colors of a normal picture and has negative relation of black and white to a normal picture.

A further object of the present invention is to get a reversed picture which has negative colors of black and white to a normal picture and has same colors except for black and white as a normal picture.

The display apparatus in accordance with the present invention can provide a reversed picture which has negative colors of black and white to a normal picture and of which ground color is variable.

The display apparatus in accordance with the present invention comprises:

- a signal source means for generating color signals,
- an inverting circuit for changing said color signals responding with state of a switching means,
- an output circuit for image signals for amplifying an output signal from said inverting circuit, and
- a display device for displaying an output signal from said output circuit.

DETAILED DESCRIPTION OF THE PREFERRED EMBODIMENTS

[First Embodiment]

A first embodiment is described referring to a display apparatus which can yield a reversed picture which has negative colors of black and white to a normal picture and which has complementary colors to a normal picture.

Figure 1:
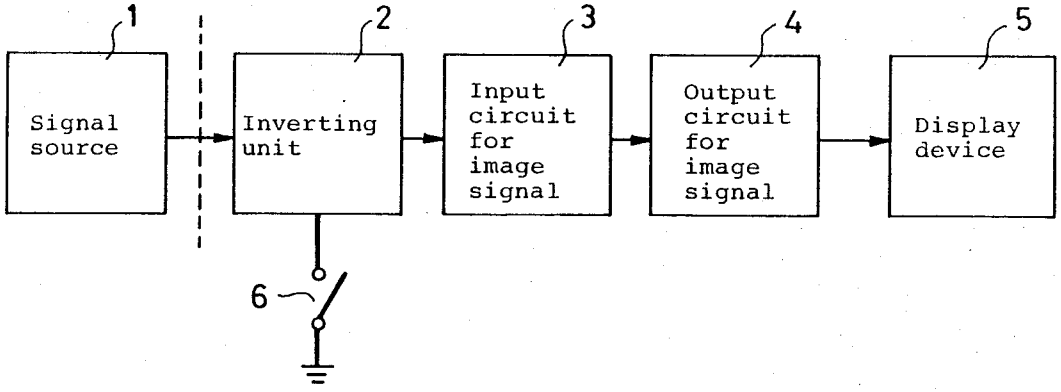
FIG. 1 and FIG. 2 are block diagrams of the preferred embodiments of the display apparatus of the present invention.
Figure 2:
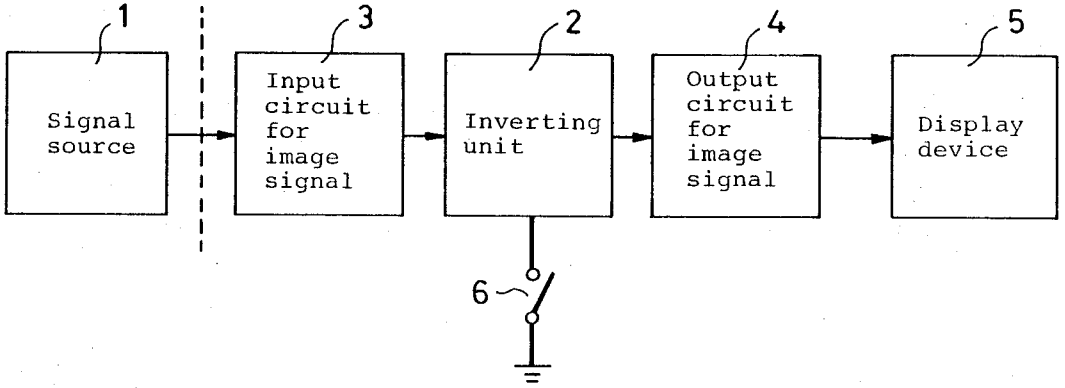

Referring now to FIG. 1 and FIG. 2, the first embodiment of the display apparatus of the present invention is diagrammatically illustrated. In FIG. 1 and FIG. 2, reference numeral 1 designated a signal source, numeral 2 designates an inverting unit, numeral 3 designates an input circuit for image signal, numeral 4 designates an output circuit for image signal, numeral 5 designates a display device, and numeral 6 designates a switch for switching means.

In FIG. 1, an image signal from the signal source 1 is inverted by the inverting unit 2 if the switch 6 is open. This inverted signal is processed (e.g. amplified) at the input circuit 3 for the image signal and the output circuit 4 for the image signal. This output signal of the output circuit 4 is transduced into an image by the display device 5. The image signal from the signal source 1 is not inverted by the inverting unit 2 when the switch 6 is closed. This non-inverted signal, i.e., the normal signal is transduced into an image by the display device 5.

In FIG. 2, an image signal from the signal source 1 first is processed (e.g., amplified) by the input circuit 3. An output signal of the input circuit 3 is inverted by the inverting unit 2 when the switch 6 is opened. This inverted signal is transduced into an image by the display device 5 after being processed at the output circuit 4. The output signal of the input circuit 3 is not inverted at the inverting unit 2 when the switch 6 is closed. This non-inverted signal, i.e., normal signal is transduced into an image by the display device 5.

Figure 3:
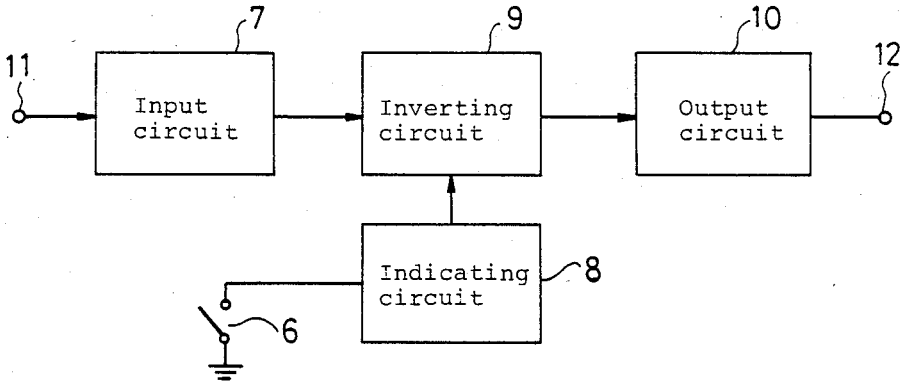
FIG. 3 is a partial block diagram of the display apparatus illustrated in FIG. 1 and FIG. 2.

In FIG. 3, the inverting unit 2 and the switch 6 as shown in FIG. 1 and FIG. 2 are diagrammatically illustrated in detail. In FIG. 3, reference numeral 7 designates an input circuit, numeral 8 designates an indicating circuit, numeral 9 designates an inverting circuit, numeral 10 designates an output circuit, numeral 6 designates the switch for controlling inverting, numeral 11 designates an input terminal, and numeral 12 designates an output terminal. A signal applied to the input terminal 11 is amplified by the input circuit 7. The amplified signal is inputted into inverting circuit 9. The indicating circuit 8 outputs a command signal which commands an inverting operation of inverting circuit 9, when the switch 6 is open. An inverted signal or a non-inverted signal is selectively to the terminal 12 through the output circuit 10.

Figure 4:
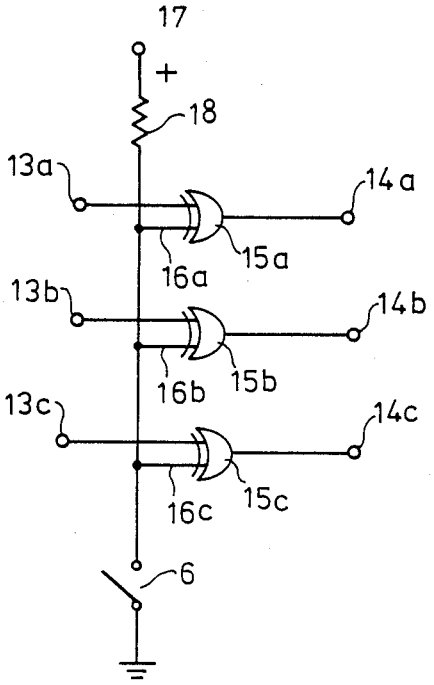
FIG. 4 is a circuit diagram of the block diagram illustrated in FIG. 3.

FIG. 4 illustrates a circuit diagram of the inverting circuit 9, the indicating circuit 8 and the switch 6. In FIG. 4, each of the input terminals 13*a*, 13*b* and 13*c* are independent from each other. The input terminals 13*a*, 13*b* and 13*c* correspond to output terminals 14*a*, 14*b* and 14*c*, respectively. Reference numerals 16*a*, 16*b* and 16*c* designate exclusive OR circuits (hereinafter referred to as EX.OR), numeral 17 designates a terminal connected a power supply, and numeral 18 designates a pull-up resistance.

This circuit changes color image signals for indicating black and white into negative color image signals, and changes color image signals other than those indicating black and white into complementary color image signals when switch 6 is open.

The color image signal consists of red, green and blue signals. For example, the color image signal indicating a black has red, green and blue signals each having low voltage level. The red signal is impressed on the terminal 13*a*, the green signal is impressed on the terminal 13*b*, and the blue signal is impressed on the terminal 13*c*. Each of output terminals 14*a*, 14*b* and 14*c* has an inverted voltage level to each corresponded input terminals 13*a*, 13*b* and 13*c*, because the terminals 16*a*, 16*b* and 16*c* of EX.OR gate 15*a*, 15*b* and 15*c* are low level when the switch 6 is open. Therefore, a color image signal indicating black (i.e., all input terminals 13*a*, 13*b* and 13*c* being low level) or white (i.e., all input terminals 13*a*, 13*b* and 13*c* being high level) is changed, negative color image signal indicating negative color against the color image signal. Other color image signals indicating colors other than black and white are changed to complementary color image signals indicating complementary colors to said other color image signal. Table 1 shows a relation between voltage levels at the input terminals 13*a*, 13*b* and 13*c* and the output terminal 14*a*, 14*b* and 14*c*, respectively.

TABLE 1

| A color indicated by input signal | A voltage level at Terminal 13a | Terminal 13b | Terminal 13c | A voltage level at Terminal 14a | Terminal 14b | Terminal 14c | A color indicated by output signal |
|---|---|---|---|---|---|---|---|
| White | H | H | H | L | L | L | Black |
| Yellow | H | H | L | L | L | H | Blue |
| Magenta | H | L | H | L | H | L | Green |
| Red | H | L | L | L | H | H | Cyan |
| Cyan | L | H | H | H | L | L | Red |
| Green | L | H | L | H | L | H | Magenta |
| Blue | L | L | H | H | H | L | Yellow |
| Black | L | L | L | H | H | H | White |

*H: "High" level
L: "Low" level

When switch 6 is closed, this circuit does not change a signal indicating a color image. The output terminals 14*a*, 14*b* and 14*c* have the same voltage levels as input terminals 13*a*, 13*b* and 13*c*, which are impressed with red, green and blue signals of the color image signal, respectively, because terminals 16*a*, 16*b* and 16*c* of EX.OR 15*a*, 15*b* and 15*c* are at a high level when the switch 6 is closed.

The display apparatus in accordance with the first embodiment is easy to operate, because the display apparatus can reverse the color image signal using the inverting unit 2 and without using software. Also, the display apparatus can display letters in the same way as if black letters are printed on white paper. Therefore, the operator is given a feeling of naturalness. The display apparatus can display a positive picture of color negative film by inputting a color image signal of negative film which is generated by a TV camera or the like.

[Second Embodiment]

The second embodiment is directed to a display apparatus which can provide a partially reversed picture which has negative colors of black and white against a normal picture. The display apparatus changes the colors of black and white image and does not change images of other colors.

Figure 5:
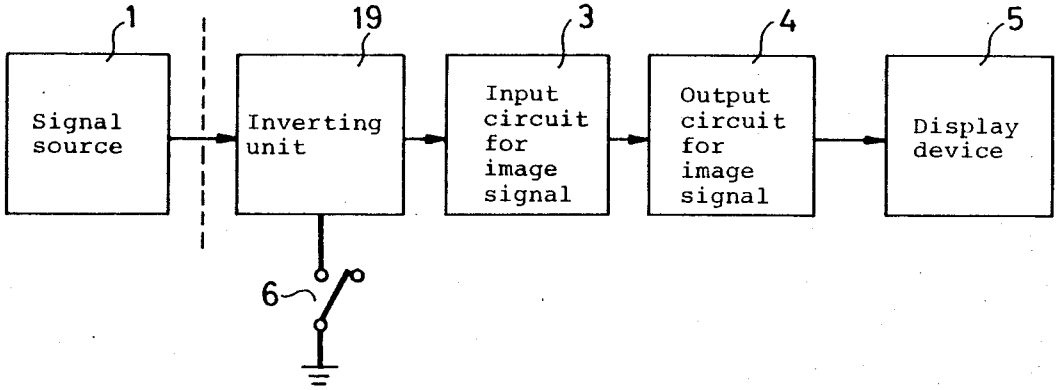
FIG. 5 and FIG. 6 are block diagrams of another embodiment of the display apparatus of the present invention.
Figure 6:
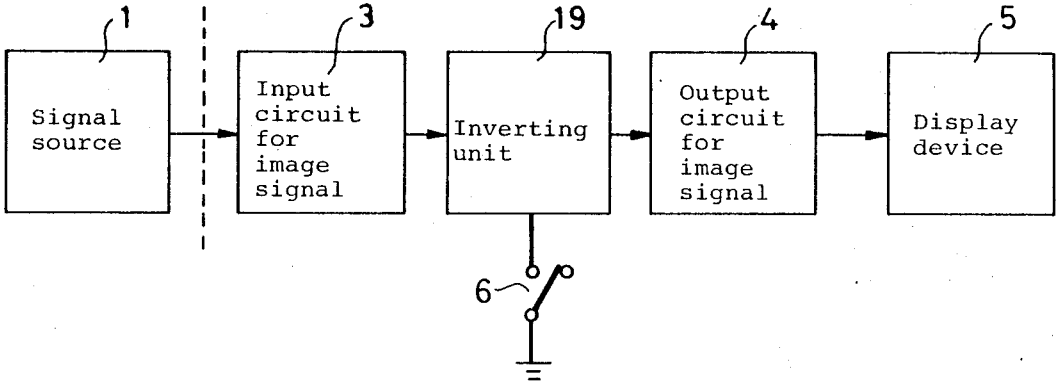

FIG. 5 and FIG. 6 diagrammatically illustrate the second embodiment of the display apparatus of the present invention. In FIG. 5 and FIG. 6, reference numeral 1 designates a signal source, numeral 3 designates an input circuit for an image signal, numeral 4 designates an output circuit for an image signal, numeral 5 designates a display device, numeral 6 designates a switch and numeral 19 designates an inverting unit illustrated in FIG. 7 in detail. Same blocks have a same reference numeral as FIG. 1 and FIG. 2.

In FIG. 5, an image signal from the signal source 1 is inputted in the inverting unit 19. The inverting unit 19 detects image signals indicating black and white. The inverting unit 19 inverts the detected image signals indicating black and white in the case where the switch 6 is closed. The inverting unit 19 does not invert image signals indicating colors other than black and white. An output signal from the inverting unit 19 is processed (e.g., is amplified) at the input circuit 3 for the image signal and the output circuit 4 for the image signal. An output signal from the output circuit 4 is transduced into a monochromatic image having negative or positive tone, or a color image having positive color by the display device 5.

When switch 6 is open, none of the image signals from the signal source 1 are inverted by the inverting unit 2. This non-inverted signal is transduced into a monochromatic image having positive tone or a color image having positive color by the display device 5.

In FIG. 6, an image signal from the signal source 1 is first processed (e.g., amplified) by the input circuit 3. An output signal from the input circuit 3 is inputted in the inverting unit 19. The inverting unit 19 detects an image signal indicating a black and white. The inverting unit 19 inverts the detected image signals indicating black and white when the switch 6 is closed, to form a negative signal. The inverting unit 19, however, does not invert an image signal indicating a color image that is not black and white. An output signal from the inverting unit 19 is processed (e.g., amplified) by the output circuit 4. An output signal from the output circuit 4 is transduced into an image by the display device 5.

When switch 6 is open, none of the image signals from the signal source 1 are inverted by the inverting unit 2. This non-inverted signal is transduced into an image by the display device 5.

Figure 7:
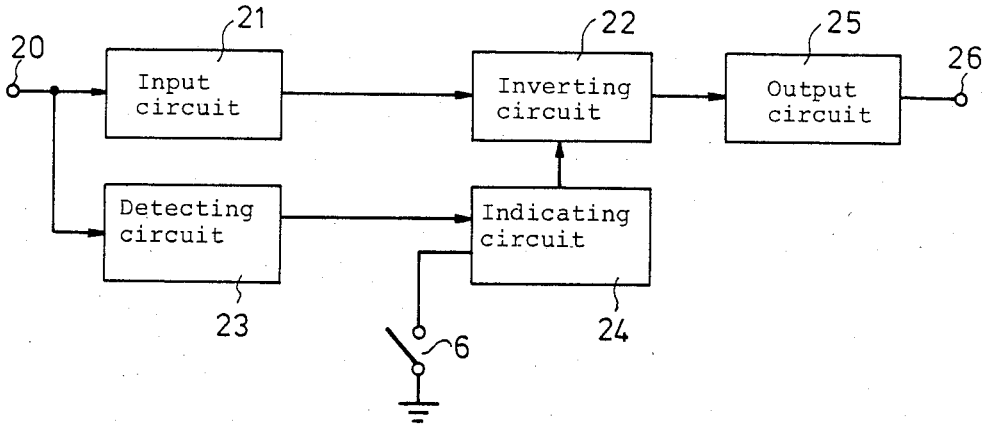
FIG. 7 is a partial block diagram of the display apparatus illustrated in FIG. 5 and FIG. 6.

FIG. 7 diagrammatically shows the inverting unit 19 as shown in FIG. 5 and FIG. 6 and switch 6 in detail. A signal applied to an input terminal 20 is amplified by an input circuit 21. The amplified signal is inputted to inverting circuit 22. Also, the signal inputted to an input terminal 20 is distinguished between a monochromatic signal (i.e., a signal indicating black or white) and a color signal at a detecting circuit 23. The detecting circuit 23 outputs a detecting signal when the monochromatic signal is inputted. An indicating circuit 24 outputs a command signal which causes the inverting operation of inverting circuit 22, when the switch 6 is closed and the monochromatic signal is inputted. An inverted signal or a non-inverted signal is inputted to a terminal 26 through an output circuit 25.

Figure 8:
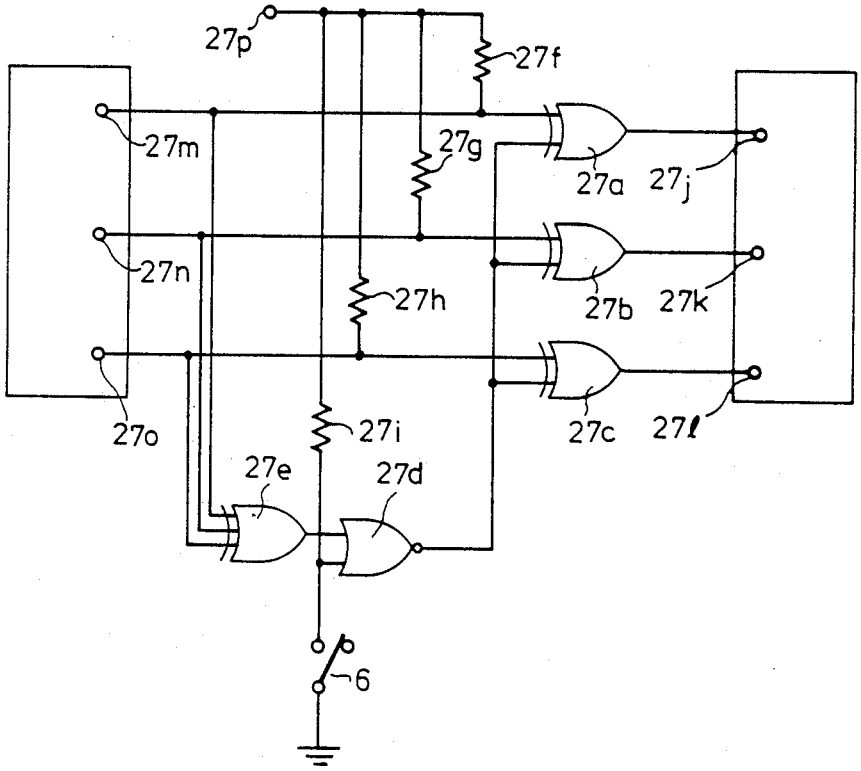
FIG. 8 is a circuit diagram of the block diagram illustrated in FIG. 7.

FIG. 8 shows a circuit diagram of the inverting circuit 22, the indicating circuit 24, the detecting circuit 23 and the switch 6. Reference numerals 27*a*, 27*b* and 27*c* designate exclusive OR gates (hereinafter referred to as EX.OR gate) having two input terminals, numeral 27*d* designates NOR gate having two input terminals, numeral 27*e* designates an EX.OR gate having three input terminals, numeral 6 designates a switch, numerals 27*f*, 27*g*, 27*h* and 27*i* designate pull-up resistances, numeral 27*m* designates an input terminal impressed with a red signal of the color image signal, numerals 27*n* and 27*o* designate an input terminal impressed with green and blue signals respectively, and numeral 27*p* designates a terminal connected to a power supply. The input terminals 27*m*, 27*n* and 27*o* are connected to the signal source 1 or the input circuit 3 for image signal. Output terminals 27*j*, 27*k* and 27*l* are connected to the input circuit 3 for image signal or the output circuit 4 for image signal.

When switch 6 is closed, this circuit reverses inputted color image signal, indicating black or white into negative color image signals, but does not change inputted color image signal indicating other colors than black or white.

When the color image signal indicating black or white is impressed, the signal causes voltage levels of the input terminals 27*m*, 27*n* and 27*o* all high levels or all low levels, and makes voltage level of an output of the EX.OR gate 27*e* low level. The low level output of the EX.OR gate 27*e* produces high level output of the NOR gate 27*d* when the switch 6 is closed. The high level output of the NOR gate is impressed on input terminals of EX.OR gates 27*a*, 27*b* and 27*c*. Therefore, the inputted color image signals indicating black and white are changed into negative color image signals indicating negative color as compared with the original color image signal.

When a color image signal indicating a color other than black and white is impressed, the signal does not input voltage levels to the input terminals 27*m*, 27*n* and 27*o* of all high or all low levels (see Table 1) and therefore a voltage level of an output of the EX.OR gate 27*e* assumes a high level. The high output of the EX.OR gate 27*e* produces a low output of the NOR gate 27*d*. The low output of the NOR gate 27*d* is impressed on input terminals of EX.OR gates 27*a*, 27*b* and 27*c*. Therefore, the inputted color image signal indicating a color other than black and white appears on the output terminals 27*j*, 27*k* and 27*l* in the same voltage level.

In case where the switch 6 is open, the circuit shown in FIG. 8 changes none of the inputted color image signals. When the switch 6 is open, the pull-up resistace 27*i* makes an input terminal of the NOR gate 27*d* high voltage level. The high voltage level of the NOR gate 27*d* makes an output terminal of the NOR gate 27*d* low voltage level regardless of a voltage level of another input terminal of NOR gate 27*d*. The low output of the NOR gate is impressed on input terminals of EX.OR gates 27*a*, 27*b* and 27*c*. Therefore, all kinds of the inputted color image signals appear on the output terminals 27*j*, 27*k* and 27*l* in the same voltage level.

The display apparatus in accordance with the second embodiment operates very efficiently for inverting, because the display apparatus can reverse the image signal by the inverting unit 19 without using software. Also, the display apparatus can display letters as if black letters printed on white paper by pen. Further, the display apparatus can only reverse the monochromatic image signal other than the color image signal indicating colors other than black and white. Furthermore, the display apparatus can display a positive picture of a monochromatic negative film by inputting a monochromatic image signal which is generated by TV camera, etc.

[Third Embodiment]

A third embodiment is directed to a display apparatus which can get a partial reversed picture which has negative monochromatic colors and can change a color of the white part (e.g., a white background) obtained by reversing it into another color.

Figure 9:
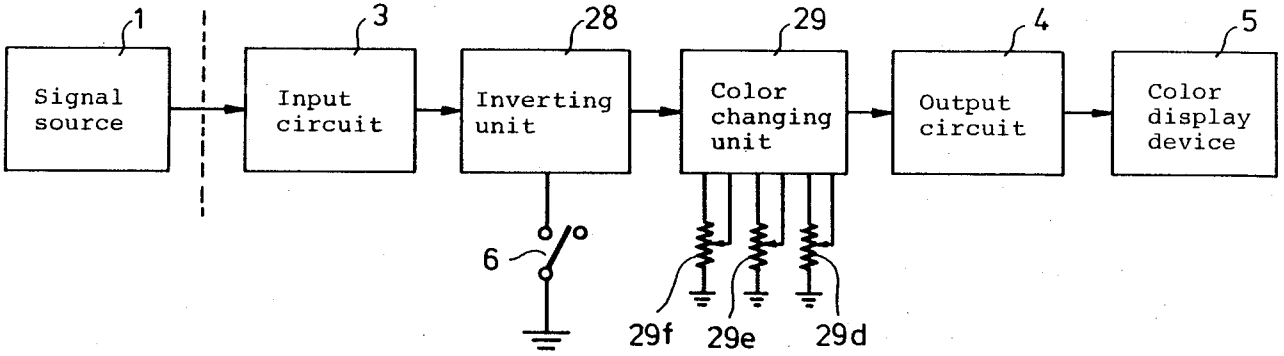
FIG. 9 is a block diagram of another embodiment of the display apparatus of the present invention.

Referring now to FIG. 9, the third embodiment of the display apparatus of the present invention is diagrammatically described. In FIG. 9, reference numeral 1 designates a signal source, numeral 3 designates an input circuit for an image signal, numeral 4 designates an output circuit for the image signal, numeral 5 designates a color display device, numeral 6 designates a switch, numeral 28 designates an inverting unit, numeral 29 designates a color changing unit for background color and numerals 30*a*, 30*b* and 30*c* designate variable resistances for red, green and blue.

In FIG. 9, an image signal from the signal source 1 is processed (e.g., amplified) by the input circuit 3. An output signal from the input circuit 3 is inputted in the inverting unit 28. The inverting unit 28 detects an image signal indicating black or white. The inverting unit 28 inverts the detected image signal indicating black or white when the switch 6 is closed. The inverting unit 28 does not invert an image signal indicating a color other than black and white. An output signal from the inverting unit 28 is inputted in the color changing unit 29. The inverted image signal indicating white is changed into an image signal indicating another color in accordance with resistance values of the variable resistances 29*f*, 29*e* and 29*d* for red, green and blue. An output signal from the color changing unit 29 is processed (e.g., amplified) by the output circuit 4. An output signal from the output circuit 4 is transduced into an image by the display device 5.

In case where the switch 6 is open, none of the image signals from the signal source 1 are inverted at the inverting unit 28. This non-inverted signal is not changed at the color changing unit 29. This non-inverted and non-changed signal is transduced into an image having positive colors and a non-changed background color by the display device 5.

Figure 10:
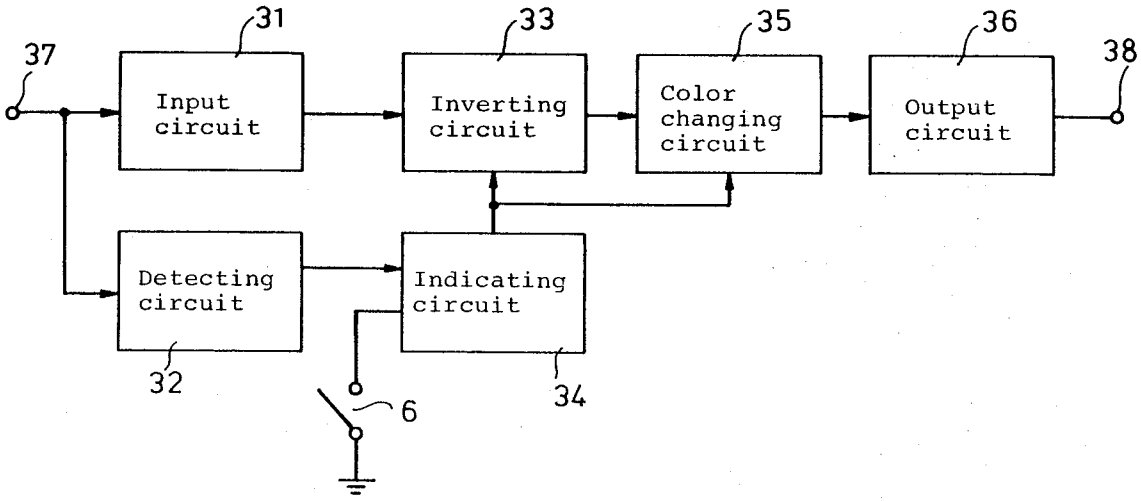
FIG. 10 is a partial block diagram of the display apparatus illustrated in FIG. 9.

In FIG. 10, the inverting unit 28 and the color changing unit 29 as shown in FIG. 9 are described in detail and diagrammatically illustrated. A signal inputted at an input terminal 37 is amplified by an input circuit 31. The amplified signal is inputted into inverting circuit 33. Also, the signal inputted to an input terminal 37 is distinguished between a monochromatic signal, i.e., a signal indicating black or white, and a color signal at a detecting circuit 32. The detecting circuit 32 outputs a detecting signal when the monochromatic signal is inputted. An indicating circuit 34 outputs a command signal which commands are inverting operation of the inverting circuit 22 and commands a color-changing operation of a color-changing circuit 35, when the switch 6 is closed and the monochromatic signal is inputted. The color-changing circuit 35 changes only a color image signal indicating white into another color image signal indicating another color. An inverted and changed signal or a non-inverted and non-changed signal is outputted at a terminal 38 through an output circuit 36.

Figure 11:
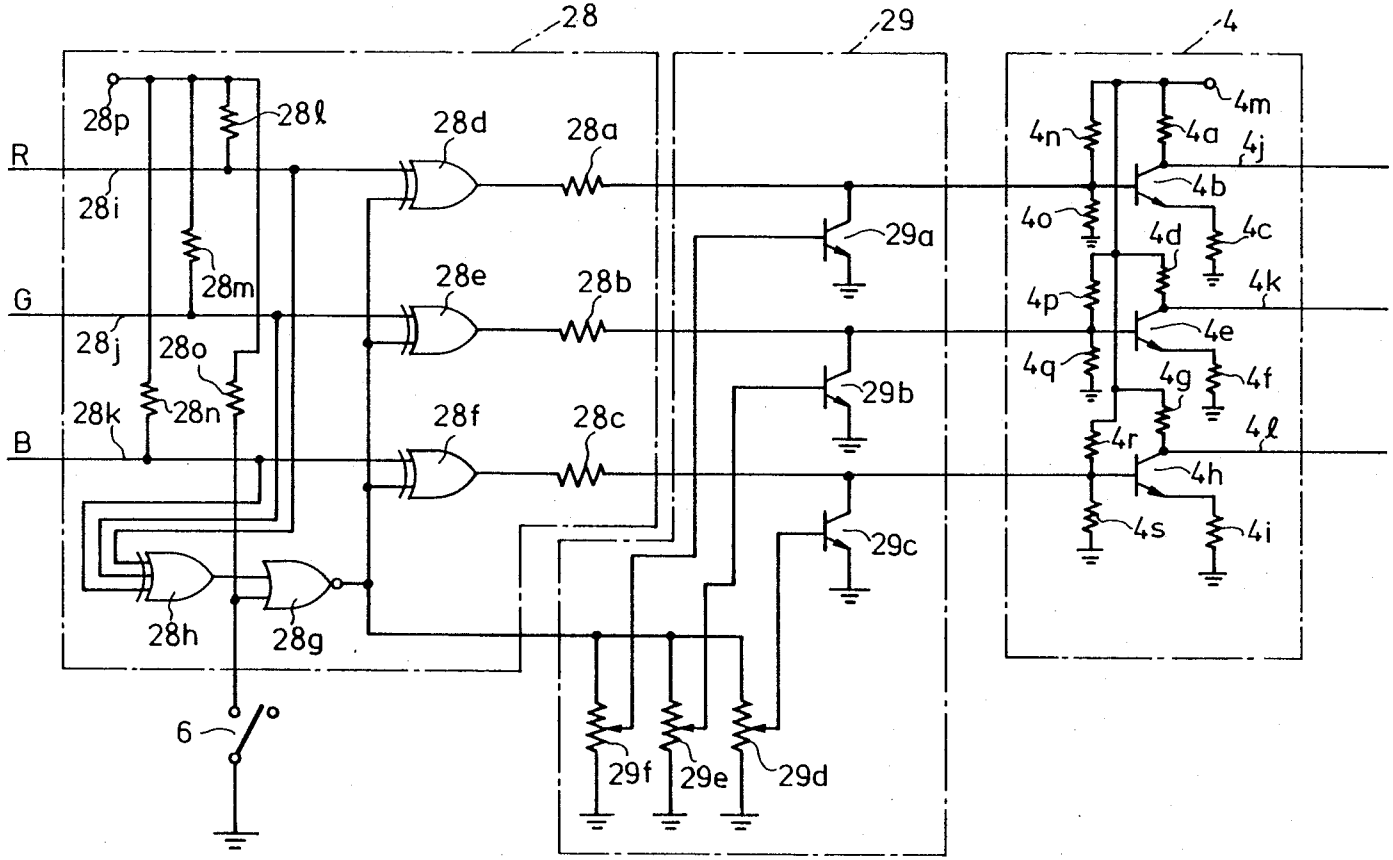
FIG. 11 is a circuit diagram of the block diagram illustrated in FIG. 10.

FIG. 11 shows a circuit diagram of the inverting unit 28, the color changing unit 29 and the output circuit 4. Reference numerals 28*a*, 28*b* and 28*c* designate current limiting resistances, numerals 28*d*, 28*e l and 28f* designate exclusive OR gates (hereinafter referred to as EX.OR gate) having two input terminals, numeral 28*g* designates a NOR gate having two input terminals, numeral 28*h* desingates an EX.OR gate having three input terminals, numerals 28*i*, 28*j* and 28*k* designate signal input lines impressed with red, green and blue signals of the color image signal, respectively; numerals 28*l*, 28*m*, 28*n* and 28*o* designate pull-up resistances, numeral 28*p* designates a terminal connected to +5 V power supply, numeral 29*a*, 29*b* and 29*c* designate NPN transistors, numerals 29*d*, 29*e* and 29*f* designate variable resistances, numerals 4*a*, 4*c*, 4*d*, 4*f*, 4*g* and 4*i* designate resistances, numerals 4*j*, 4*k* and 4*m* designate signal output lines for red, green and blue signals of the color image signal, respectively, numeral 4*m* designates a terminal connected to +12 V power supply and, numerals 4*n*, 4*o*, 4*p*, 4*g*, 4*r* and 4*s* designate bias resistances for bases of the transistors. Numeral 28 designates the inverting unit, numeral 29 designates the changing color unit and numeral 4 designates the output circuit for the image signal.

The inverting unit 28 reverses an inputted color image signal indicating black or white into a negative color image signal, but does not change inputted color image signals except for indicating colors other than black or white when the switch 6 is closed. This operation of the inverting unit 28 is same as the inverting unit 19 described in the second embodiment.

When switch 6 is open, the inverting unit 28 does not reverse all kinds of inputted color image signals. This operation is also same as the inverting unit 19 described in the second embodiment.

The color changing unit 29 changes the inputted signal indicating white (which is used mostly as background) into another signal indicating another color. This unit operates only when an output of NOR gate 28*g* is a high level, that is, when the signal indicating white, which has been reversed at inverting unit 28, is inputted. The high voltage level of NOR gate 28*g* is impressed on the variable resistances 29*d*, 29*e* and 29*f*. Divided voltages at the variable resistances 29*d*, 29*e* and 29*f* are impressed on bases of the transistors 29*a*, 29*b* and 29*c*. Therefore, voltage values of the collectors of the transistors 29*a*, 29*b* and 29*c* are variable using the variable resistances 29*f*, 29*e* and 29*d*, respectively. The variable resistances 29*f*, 29*e* and 29*d* change the separating color balance of the inputted signal indicating white consisting the red, green and blue signal of high level, respectively. (See Table 1).

The output circuit 4 for image signal amplifies the output signal from the changing color unit 29. This output circuit 4 linearly amplifies the signal. The bases of the transistors 4*b*, 4*e* and 4*h* are impressed with bias voltages by the bias resistances 4*n*, 4*o*, 4*p*, 4*q*, 4*r* and 4*s*. An amplification factor of this circuit is given by [resistance value of resistance 4*a*]/[resistance value of resistance 4*c*]. The output signal from the output circuit 4 is impressed on the display device 5.

The display apparatus in accordance with the third embodiment can change the background color in a way to reduce fatigue to the operator.

Figure 12:
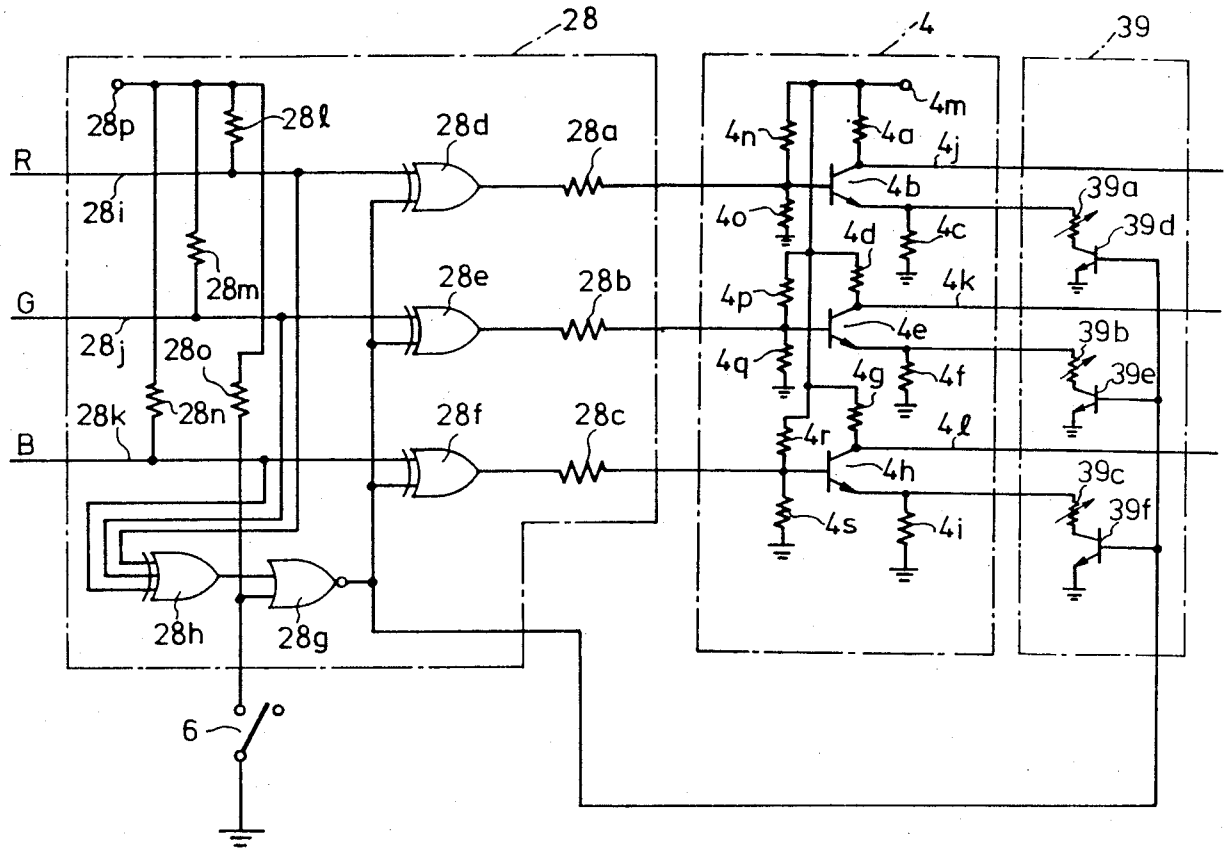
FIG. 12 is a partial circuit diagram of another embodiment of the display apparatus of the present invention.

FIG. 12 shows another embodiment of the color changing unit 39 comprising variable resistances 39*a*, 39*b*, and 39*c* and emitter grounded transistors 39*d*, 39*e* and 39*f*. The variable resistances 39*a*, 39*b* and 39*c* are connected in parallel to the resistances 4*c*, 4*f* and 4*i* of the output circuit 4, respectively. The transistors 39*d*, 39*e* and 39*f* have collectors connected to said variable resistances 39*a*, 39*b* and 39*c* respectively and bases connected to the output terminal of the NOR gate 28*g*.

The color changing unit 39 changes the inputted signal indicating white (which is used mostly as background) into another signal indicating another color. This unit operates only when an output of NOR gate 28*g* is high level, that is, the signal indicating white, which has been reversed at inverting unit 28, is inputted. The high voltage level of NOR gate 28*g* is impressed on the bases of the transistors 39*d*, 39*e l and 39f* and bias transistors 39*d*, 39*e* 39*f* to on-states. Voltage values of the collectors of the transistors 4*b*, 4*e* and 4*h* can be varied by the variable resistances 39*a*, 39*b* and 39*c*, respectively, because amplification factors of the transistors 4*b*, 4*e* and 4*h* are variable by the variable resistance 39*a*, 39*b* and 39*c*, respectively.

[Other Embodiments]

In place of the color display device 5 used in above embodiments, a black and white display device may be substituted therefor to obtain substantially the same results. The embodiment using the black and white display device can display an image which has black letters on white background.

Further, in place of the color display device 5 used in above embodiments, a monochromatic display device, e.g., green display device, may be substituted therefor to obtain substantially the same results. The embodiment using the green display device can display an image which has black letter on green ground.

What is claimed is:

1. A display apparatus comprising:

means for receiving color component signals comprising red, green and blue signals representing pixels;

first means for (1) determining if said color component signals for a given pixel define a black signal or a white signals, (2) inverting said color component black or white signals to signals which define a reversed black or white signal, black becoming white and white becoming black and (3) selectively changing all signals representing other colors other than black and white into complementary color signals; and switch means for controlling whether said first means changes said other color signals into said complimentary color signals.

2. Apparatus as in claim 1 further comprising:

an image signal output circuit for amplifying an output signal from said first means, and display means for displaying an output signal from said output circuit.

3. A display apparatus comprising:

means for receiving color component signals comprising red, green and blue signals representing pixels;

detecting means for determining if said color component signals for a given pixel define a black signal or a white signal, and for generating a detecting signal when said determination is positive;

first means, upon receipt for said detecting signal, for selectively inverting the color component signals of that pixel to define a reversed black and white signal, black becoming white and white becoming black, and not changing color signals representing colors other than black and white; and switch means for controlling whether said first means inverts said color component signals representing black or white.

4. A display apparatus in accordance with claim 3, further comprising:

a color changing circuit having means for varying values of said red, green and blue color component signals of said given pixel when such signals define a white signal, when said white signal is one which has been generated from an inverted black signal whereby a color other than black or white is generated.

5. Apparatus as in claim 3 further comprising:

an image signal output circuit for amplifying an output signal from said first means, and display means for displaying an output signal from said output circuit.

* * * * *